US007714739B2

(12) United States Patent
Schensky

(10) Patent No.: US 7,714,739 B2
(45) Date of Patent: May 11, 2010

(54) ILLUMINATED DEADBOLT HANDLE ASSEMBLY

(76) Inventor: Dan Schensky, 1301 Manchester, Waunakee, WI (US) 53597

( * ) Notice: Subject to any disclaimer, the term of this patent is extended or adjusted under 35 U.S.C. 154(b) by 29 days.

(21) Appl. No.: 12/116,242

(22) Filed: May 7, 2008

(65) Prior Publication Data

US 2009/0178450 A1 Jul. 16, 2009

Related U.S. Application Data

(60) Provisional application No. 61/020,451, filed on Jan. 11, 2008.

(51) Int. Cl.

| | |
|---|---|
| ***G08B 21/00*** | (2006.01) |
| ***G08B 13/08*** | (2006.01) |
| ***H01H 27/06*** | (2006.01) |
| ***E05B 41/00*** | (2006.01) |
| ***E05B 39/04*** | (2006.01) |

(52) U.S. Cl. ..... 340/687; 340/686.1; 340/686.3; 340/545.6; 340/545.7; 200/43.08; 70/432; 70/434

(58) Field of Classification Search ..... None
See application file for complete search history.

(56) References Cited

U.S. PATENT DOCUMENTS

| | | | | |
|---|---|---|---|---|
| 1,145,206 | A | 7/1915 | Moore et al. | |
| 2,286,463 | A | 6/1942 | Chaskin | |
| 4,490,999 | A | 1/1985 | Castle et al. | |
| 4,559,796 | A | 12/1985 | De Forrest, Sr. | |
| 4,683,741 | A | 8/1987 | Fields | |
| 5,111,007 | A * | 5/1992 | Miller et al. | 200/43.08 |
| 5,311,168 | A | 5/1994 | Pease, Jr. et al. | |
| 5,845,523 | A * | 12/1998 | Butterweck et al. | 70/278.1 |
| 6,078,256 | A | 6/2000 | Gottlieb | |
| 6,192,718 | B1 * | 2/2001 | Bollinger et al. | 70/2 |
| 6,950,033 | B1 * | 9/2005 | Guyre | 340/687 |
| 2007/0214848 | A1 * | 9/2007 | Meyerle et al. | 70/278.2 |
| 2008/0289383 | A1 * | 11/2008 | Levine | 70/432 |

* cited by examiner

*Primary Examiner*—Julie Lieu
(74) *Attorney, Agent, or Firm*—Joseph T. Leone, Esq.; DeWitt Ross & Stevens S.C.

(57) ABSTRACT

A self-contained handle assembly for a door provides a light emitting diode which indicates whether the door is locked or unlocked. The LED blinks when the door is locked and thus provides an active reminder of the position of the deadbolt.

7 Claims, 6 Drawing Sheets

ILLUMINATED DEADBOLT HANDLE ASSEMBLY

CROSS-REFERENCE TO RELATED APPLICATIONS

Priority is hereby claimed to provisional application Ser. No. 61/020,451, Filed Jan. 11, 2008, which is incorporated herein by reference.

FIELD OF THE INVENTION

This invention relates to a deadbolt latch handle or latch handle cover for use in door lock assemblies. More specifically, this invention relates to an illuminated signal (preferably a light-emitting diode) incorporated in the deadbolt latch handle or handle cover. The signal is activated when the latch handle is secured in a locked position, indicating that the deadbolt is engaged and the door is locked.

DESCRIPTION OF THE PRIOR ART

The ever increasing number of residential burglaries in recent years has intensified the need for alarm systems and effective locking mechanisms. Typical residential alarm systems include a plurality of sensor mechanisms at various entrance points, the sensors connected by external wiring to an indicator panel or some other control panel. Typical alarm systems often include a communication link for alerting law enforcement authorities to a break-in. Unfortunately, while such alarm systems provide a number of desirable features, they are quite expensive. In the case of an alarm system retrofit to an existing building, extensive external wiring and modification to the dwelling is usually required. Until complicated alarm systems become more affordable, the most effective deterrent to burglaries is a simply securely locked door.

Today, as many as 85-90 percent of all residential burglaries are perpetrated by non-professional burglars who take advantage of an unlocked entryway. In short, burglary is largely a crime of opportunity, and an unlocked door provides the opportunity. While expensive and complicated alarm systems provide a wide range of deterrence features, their cost and complexity will not prevent residential burglaries if the system is not activated. Even when properly used, no alarm system can effectively prevent burglaries. But if the alarm system is not activated at all (due to too many false alarms), or one of the doors is left inadvertently left unlocked, the likelihood of a burglary rises dramatically.

It has been proposed to provide a limited function, self-contained alarm unit for application to a door, for example, wherein the self-contained system includes arming circuitry, alarm sensor, and alarm sounding system all in a single housing. See, for example, U.S. Pat. Nos. 5,311,168; 6,078,256; and 6,950,033. Some of these door-mounted alarm systems may also integrate a door locking mechanism such that the alarm unit is armed when the door is locked and disarmed otherwise. Additionally, door lock systems exist that indicate to a potential burglar that the door is locked and the system is armed. However, these systems do not necessarily encourage the use of the system by the resident. Residents need a simple reminder and indicator of whether or not the door is locked.

SUMMARY OF THE INVENTION

The present invention encourages the use of a simple and effective burglary prevention device: the deadbolt lock. The present invention is a slipcover which covers the latch handle of an existing deadbolt lock system and signals to the resident when the deadbolt has been engaged. (Alternatively, the invention may also comprise a replacement latch handle incorporating the signal mechanism, or an entire deadbolt lockset that incorporates the signal mechanism into the latch handle; see below.) The slipcover includes a small, low-voltage user discernible signal, such as a light-emitting diode (LED), a liquid crystal display (LCD), a small light bulb, or any other type signal that can be toggled from an "off" position to an "on" position. In the present invention, the signal, which is incorporated into the deadbolt latch, toggles to the "on" position when the latch handle has been flipped to engage the deadbolt. The signal is powered by small batteries housed inside the slip cover. Once the latch handle is flipped to the locked position, the signal toggles to the "on" position, thus indicating to the resident that the deadbolt is engaged and the door is successfully locked.

Batteries are incorporated into the latch handle or slip cover to power the signal. A timer may also be incorporated into the circuitry so that the signal, when toggled to the "on" position by the closing of the deadbolt, toggles back to the "off" position after a set period of time. The timer allows the signal to remain in the "on" position for a pre-determined length of time sufficient for the resident to notice. This helps preserve battery life. If desired, the timer can be omitted. The timer and the signal are activated by a pressure-sensitive switch embedded in the slip-cover, and which is biased to toggle the signal between the "on" and "off" positions in response to the movement of the deadbolt latch handle between the locked and unlocked positions, respectively.

The design of the present invention is well suited for the elderly, the incapacitated, and those who live alone. The present invention is easy to install and easy to use, in contrast to much more complicated alarm systems. A resident can easily install the present invention on all of the doorways of the residence. Thus, when the doors are locked, a simple glance at each door will reveal that each signal is "on," thus reminding the resident that the doors are locked. If one or more signals are still in the "off" position, this indicate to the resident that the deadbolt still needs to be engaged, and effectively reminds him to lock the doors.

The objects and advantages of the invention will appear more fully from the following detailed description of the preferred embodiment of the invention made in conjunction with the accompanying drawings.

BRIEF DESCRIPTION OF THE DRAWINGS

FIG. 6C is the top plan view; FIG. 6A is a cross-section through line A-A; FIG. 6B is a cross-section through line B-B; FIG. 6D is a left-side, vertical cross-section of FIG. 6C; FIG. 6E is a rear elevation view of FIG. 6C.

DETAILED DESCRIPTION

Figure 1:
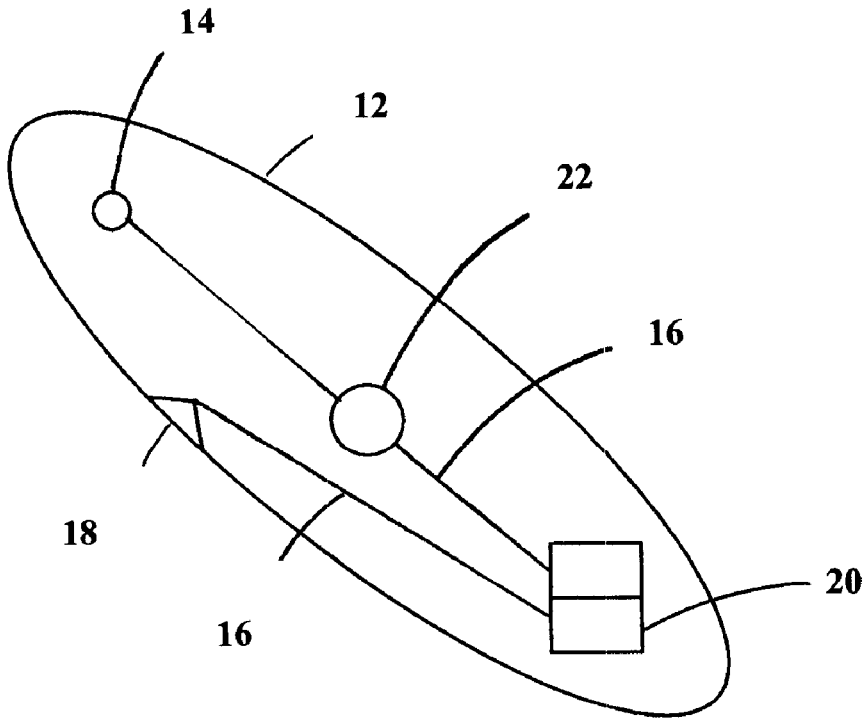
FIG. 1 is a top plan view of the present invention with batteries in an orientation parallel to the latch handle.

Throughout the drawings, the same reference numerals are used to denote the same features.

Figure 2:
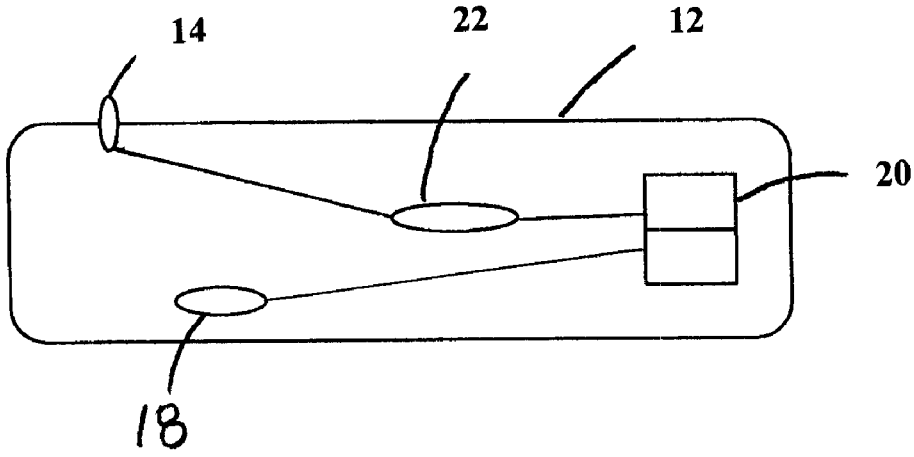
FIG. 2 is a side elevation view of the present invention.
Figure 3:
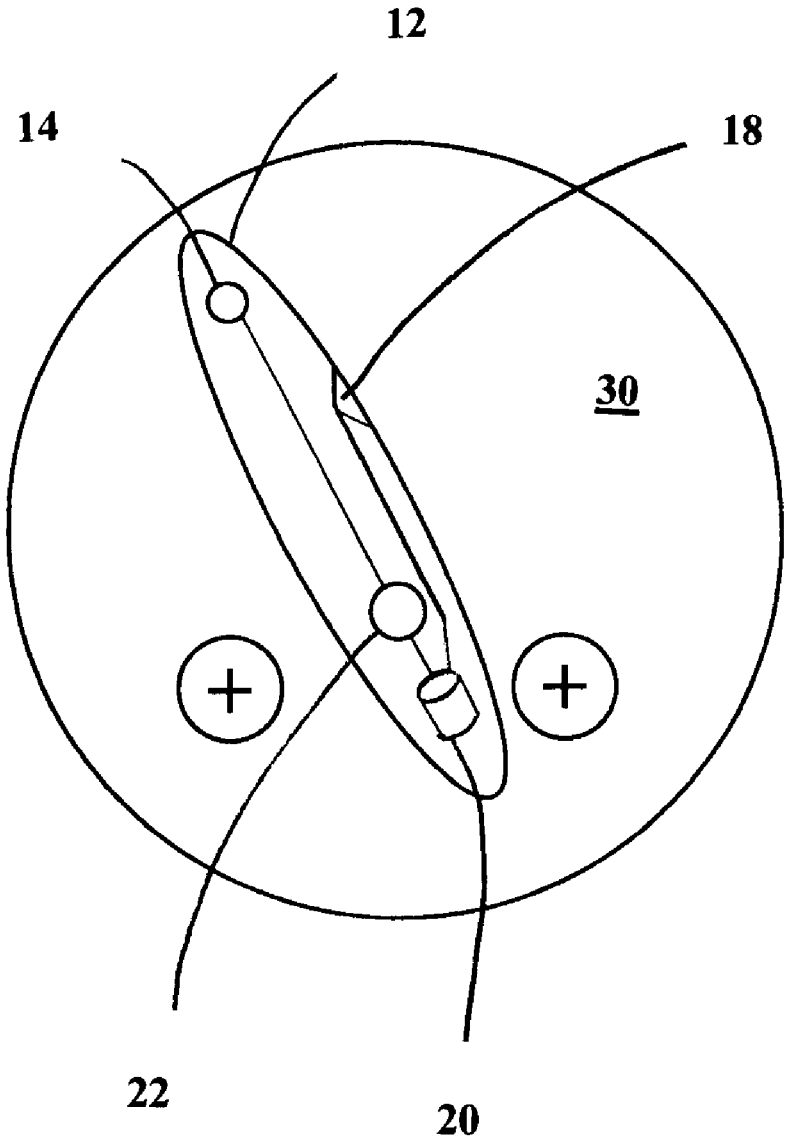
FIG. 3 is a top view of the present invention showing a deadbolt latch handle according to the present invention affixed to a deadbolt mounting plate.

FIG. 1 is an schematic, top plan view of the present invention. In this view, the plane of the door to which the invention is mounted is in the plane of the paper. In this version of the invention, the housing 12 of the device is a slipcover, which is placed over the latch handle of an existing deadbolt door lock. The slipcover is preferably constructed of metal or metalized plastic and is dimensioned and configured to be slightly larger than the existing latch. Alternatively, the slip cover may be constructed from a flexible or elastic material so that the slipcover will fit snugly over the handle without any loose edges. The slipcover has an outside surface and an inside surface; see FIG. 4. The inside surface of the slipcover is next to the door and has an opening to receive the existing deadbolt latch handle. FIGS. 1 and 2 illustrate that the outside surface has a visible signal 14 incorporated into the slip cover. As noted earlier, the signal 14 may be any type of signal, without limitation, that is dimensioned and configured to toggle between an "on" position and an "off" position. A light-emitting diode (LED) is preferred, but a small light bulb or LCD may also be used. The signal is preferably positioned distally from the rotational axis of the deadbolt latch handle. This is simply the preferred embodiment. The signal 14 may be disposed at any point on the surface of housing 12.

The signal is attached to circuitry 16 securely contained within the slipcover. The circuitry operationally connects the signal 14 to a switch 18 for turning the signal on and off, at least one battery 20 to power the signal, and an optional timer 22.

In the preferred version of the invention, the circuitry is configured so that the battery supplies power through the optional timer 22 to the signal 14 when the deadbolt is in the locked position. A switch 18 responsive to the rotation of the latch handle controls the power supply from the battery 20 to the timer 22. When the deadbolt is locked, the switch is closed, and power flows from the battery, through the timer, and into the signal, thus turning it on. When the deadbolt is unlocked, the switch is opened, and the signal is turned off. Thus, the switch is activated when the latch handle is thrown to engage the deadbolt, which locks the door.

In the preferred embodiment, the switch 18 is a simple, pressure activated switch that responds to the rotational movement of the latch handle. Simple rotary switches are well known. Any other type of switch that is responsive to the rotation of the deadbolt latch handle may also be used, for example a magnetic switch, a mercury-type gravity switch, a gyroscopically-activated switch, a reed switch, etc.

As noted earlier, the invention may be configured in the form of a slip cover that fits over the latch of an existing deadbolt lockset. Another version of the invention is a replacement latch handle which attaches to an existing deadbolt lockset. The latch handle contains the signal and circuitry noted earlier. In this version of the invention, the conventional latch handle on an existing deadbolt lockset is removed, and a latch handle according to the present invention is inserted in its place. Alternatively, an original equipment manufacturer deadbolt latch set may be manufactured that includes the present invention directly incorporated into the latch.

Figure 4:
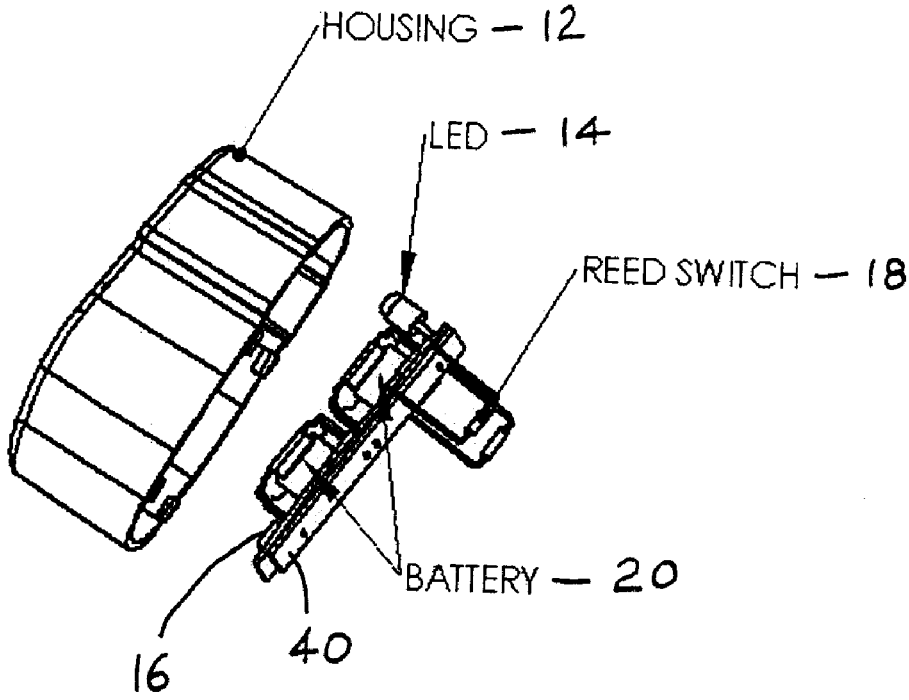
FIG. 4 is a perspective, exploded rendering of a preferred version of the present invention.
Figure 5A:
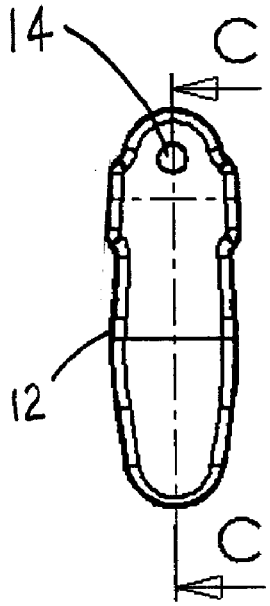
FIG. 5A is a top plan view of the version of the invention depicted in FIG. 4.
Figure 5B:
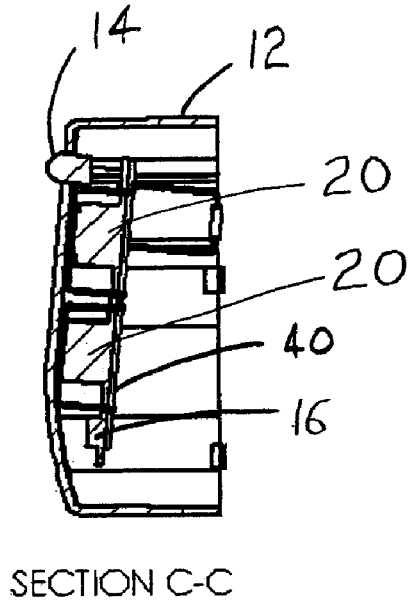
FIG. 5B is a vertical cross-section along line C-C of FIG. 5A.

FIG. 4 is a perspective, exploded rendering of a preferred version of the present invention. The back side of the housing is visible, as is frame 40 on which is anchored the batteries 20, circuitry 16 (in the form of an integrated chip) and signal 15 (depicted as an LED). FIG. 5A is a top plan view of the invention depicted in FIG. 4, and FIG. 5B is a vertical cross-section along line C-C of FIG. 5A. As can be best in FIG. 5B, the frame 40 and its associated components, fits snugly within the housing 12. The LED 14 is then visible through an aperture 14' (see FIG. 6C) in the housing 12. The frame 40 can be adhered within the frame by any mechanism known in the art, including friction, glue, solder, fasteners of any sort, etc.

Figure 6B:
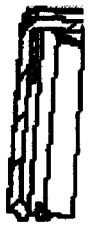
FIGS. 6A, 6B, 6C, 6D, 6E are various views of the housing 12 as shown in FIG. 4.
Figure 6E:
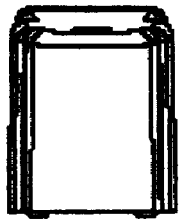
Figure 6C:
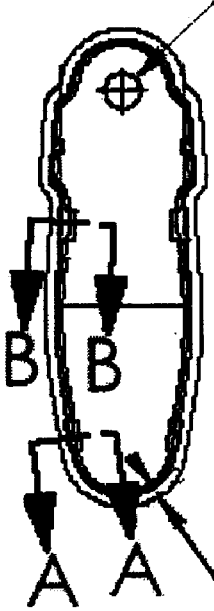
Figure 6D:
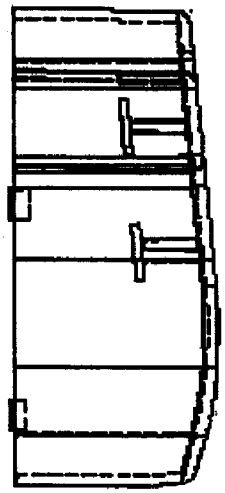
Figure 6A:
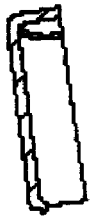

Detailed views of the housing in isolation are provided in FIGS. 6A, 6B, 6C, 6D, 6E. FIG. 6C is the top plan view of the housing; FIG. 6A is a cross-section through line A-A; FIG. 6B is a cross-section through line B-B; FIG. 6D is a left-side, vertical cross-section of FIG. 6C; FIG. 6E is a rear elevation view of FIG. 6C. Preferred dimensions (in inches) are provided. These dimensions are provided solely for purposes of illustration and are not limiting in any fashion.

Figure 7:
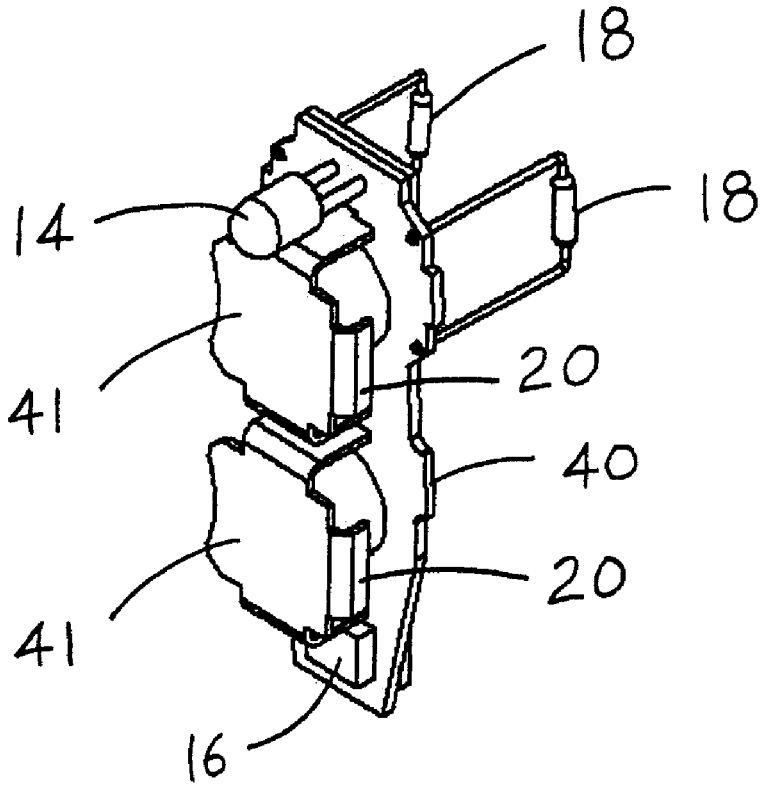
FIG. 7 is a perspective rendering of the circuitry, batteries, and LED that are contained within the housing.

FIG. 7 is a perspective rendering of the circuitry, batteries, and LED that are carried on frame 40, which is ultimately contained within the housing. The frame 40 can be fabricated from any suitably stiff or semi-flexible material, typically plastic. The frame may also be a printed circuit board, in which case the required circuitry would be incorporated directly into frame 40 itself. A micro-chip 16 is provided to activate and deactivate signal 14 in response to the position of the housing. The position of the housing is sensed by reed switch 18, which activates and deactivate the signal 14 in response to the position of the housing in which the frame is disposed. Batteries 20 are depicted within corresponding brackets 41 to hold them in place.

Figure 8:
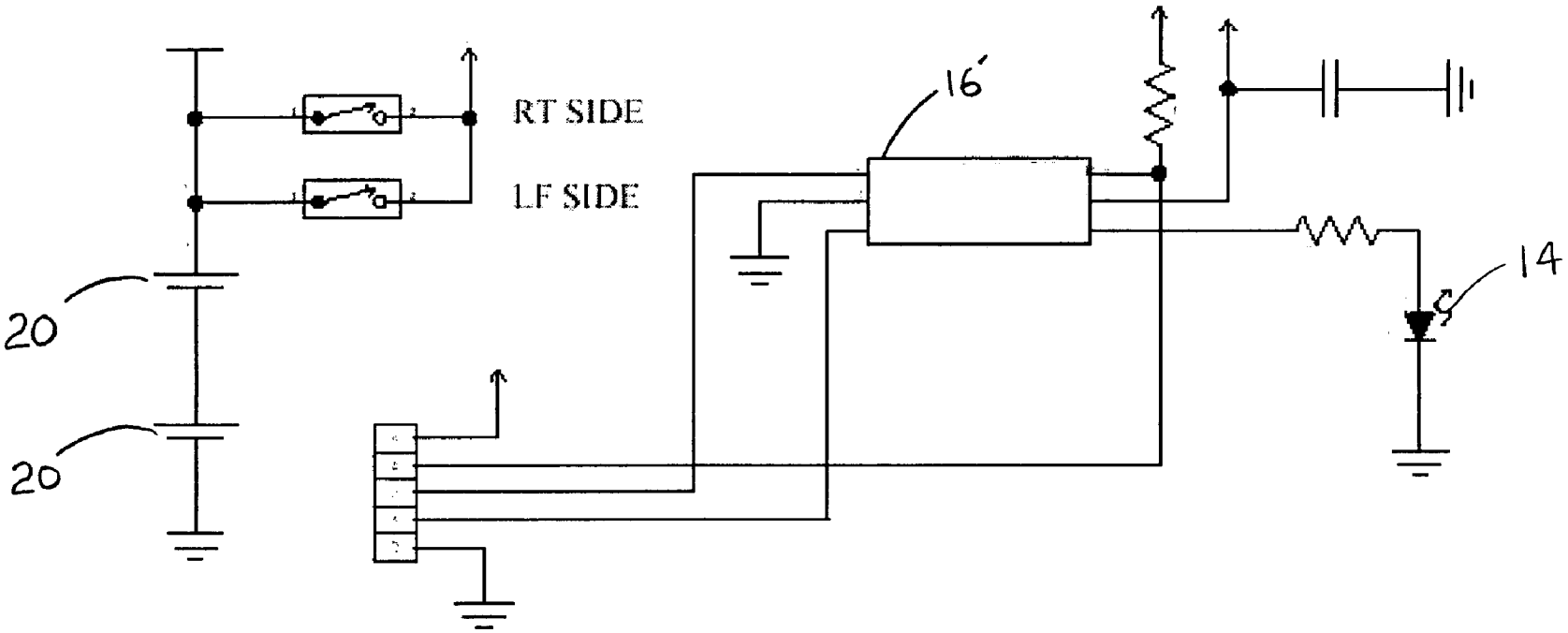
FIG. 8 is a circuit diagram illustrating how the LED 14 is energized by batteries 20 in response to motion of the handle body.

FIG. 8 is a circuit diagram illustrating how the LED 14 is energized by batteries 20 in response to motion of the handle body. The circuit is opened or closed via switches SW1 (right side) and SW2 (left side) in response to the position of the housing. The two arms of the reed valve 18 serve to open and close the circuit in response to the left or right orientation of the deadbolt lock to which the housing is attached. A micro-chip 16', such as a pic10f206, may be used to control the status of the LED. The pic10f206 is a low-cost, high-performance, 8-bit, fully static, flash-based CMOS microcontroller. It employs a RISC architecture with only 33 single-word/single-cycle instructions. All instructions are single cycle (1 μs) except for program branches, which take two cycles. It is a preferred chip because of its easy-to-use and easy to remember instruction set reduces development time significantly. A host of other functionally equivalent microcontrollers may also be used. They can be obtained from a very large number of international suppliers, such as Microchip Technology Inc., Chandler, Ariz.

It is understood that the invention is not confined to the particular construction and arrangement of parts herein illustrated and described, but embraces such modified forms thereof as come within the scope of the following claims.

The invention claimed is:

1. A latch for a lock, the latch comprising:

a housing dimensioned and configured to attach to a lock mechanism, and wherein the housing is movable between an unlocked state when the lock is unlocked, and a locked state when the lock is locked;

a signal indicator disposed within the housing, wherein the signal is switchable between an "off" state and an "on" state; and a switch disposed within the housing and connected to the signal, wherein the switch turns the signal to the "off"

state when the housing is in the unlocked state, and turns the signal to the "on" state when the housing is in the locked state;

wherein the switch mechanism is selected from the following group: a reed switch, a pressure-sensitive switch, a gyroscopic switch, and a magnetic switch.

2. The device of claim 1, wherein the switch mechanism is a pressure sensitive switch.

3. A latch for a lock, the latch comprising:

a housing dimensioned and configured to attach to a lock mechanism, and wherein the housing is movable between an unlocked position when the lock is unlocked, and a locked position when the lock is locked;

a signal indicator disposed within the housing, wherein the signal is switchable between an "off" position and an "on" position; and a switch disposed within the housing and connected to the signal, wherein the switch turns the signal to the "off" position when the housing is in the unlocked position, and turns the signal to the "on" position when the housing is in the locked position;

wherein the housing is dimensioned and configured to attach to a deadbolt lock mechanism.

4. A device comprising:

a latch handle which attaches to a lock mechanism;

a light emitting diode secured within the latch handle at a position distal from the rotational axis of the latch handle;

a circuit board, within the latch handle, to which the light emitting diode is connected;

a timer means connected to the circuit board, wherein the timer means regulates the length of time power is supplied to the light emitting diode;

a battery connected to the circuit board, wherein the battery supplies power through the timer to the light emitting diode;

a switch mechanism connected to the circuit board between the battery and the timer, whereby when the switch is activated it allows power to flow from the battery to the timer and when the switch is deactivated it disallows power to flow from the battery to the timer;

a means for indicating when the lock mechanism is secured in the locked position, whereby whenever the latch handle is thrown to the locked position, the switch mechanism is activated and allows power to flow from the battery to the timer means which temporally regulates power flowing to the light emitting diode and when power is supplied to the light emitting diode, it blinks which indicates that the latch handle is in the locked position.

5. The device of claim 4 wherein the switch mechanism is selected from the following group: a pressure sensitive switch, a gyroscopic switch, and a magnetic switch.

6. The device of claim 4 wherein the switch mechanism is a pressure sensitive switch.

7. The device of claim 4 wherein the housing is dimensioned and configured to attach to a deadbolt lock mechanism.

* * * * *